US007415850B2

(12) United States Patent
Smyczek et al.

(10) Patent No.: US 7,415,850 B2
(45) Date of Patent: Aug. 26, 2008

(54) LOCK

(75) Inventors: Cris Smyczek, Greenfield, WI (US); Mark Van Handel, Madison, WI (US); Jesse Marcelle, Muskego, WI (US)

(73) Assignee: Master Lock Company LLC, Oak Creek, WI (US)

( * ) Notice: Subject to any disclaimer, the term of this patent is extended or adjusted under 35 U.S.C. 154(b) by 0 days.

(21) Appl. No.: 11/175,751

(22) Filed: Jul. 6, 2005

(65) Prior Publication Data

US 2006/0005586 A1 Jan. 12, 2006

Related U.S. Application Data

(60) Provisional application No. 60/521,808, filed on Jul. 6, 2004.

(51) Int. Cl.
*E05B 67/00* (2006.01)
*E05B 37/00* (2006.01)
*E05B 67/28* (2006.01)

(52) U.S. Cl. ..... 70/51; 70/20; 70/27; 70/40

(58) Field of Classification Search ..... 70/21–22, 70/25, 27–28, 48, 51–53, 456 R, 395, 408, 70/267–270, 272–274, 40; 362/100, 253
See application file for complete search history.

(56) References Cited

U.S. PATENT DOCUMENTS

| | | | | | |
|---|---|---|---|---|---|
| 221,258 | A | * | 11/1879 | Walker | 70/40 |
| 345,340 | A | * | 7/1886 | Volke | 70/40 |
| 1,172,970 | A | * | 2/1916 | Fowler | 70/27 |
| 1,571,281 | A | * | 2/1926 | La Port | 70/25 |
| 2,294,505 | A | * | 9/1942 | Lindblad | 70/269 |
| 2,428,902 | A | * | 10/1947 | Young | 70/40 |
| 2,456,963 | A | * | 12/1948 | Leatherman | 70/273 |
| 2,618,956 | A | * | 11/1952 | Hanna | 70/273 |
| 2,812,851 | A | * | 11/1957 | Kinnebrew | 70/273 |
| 2,952,967 | A | | 9/1960 | Nussle | |
| 3,736,781 | A | | 6/1973 | Foote | |
| 4,866,959 | A | * | 9/1989 | Ling | 70/25 |
| 5,042,277 | A | * | 8/1991 | Jenn-Rong | 70/28 |
| 5,193,367 | A | * | 3/1993 | Ling | 70/28 |
| 5,396,785 | A | * | 3/1995 | Chen | 70/25 |

(Continued)

FOREIGN PATENT DOCUMENTS

GB 2227515 A * 8/1990

*Primary Examiner*—Patricia Engle
*Assistant Examiner*—Christopher Boswell
(74) *Attorney, Agent, or Firm*—Calfee, Halter & Griswold LLP

(57) ABSTRACT

A lock for securing to a selected base object by a user is disclosed. The lock includes a housing, a time display device secured to the housing, a locking mechanism attached to the housing, and a shackle having a first portion disposed within the housing and a second portion disposed between an open position and a closed position. When disengaged from the locking mechanism, the shackle is movable between the closed position and the open position by user manipulation of the locking mechanism. The locking mechanism can be a various styles, such as for example, a padlock or a dial combination. The shackle can be of various structures, shapes and styles. The time display device may include a rotatable face plate. The lock may include illumination means, such as for example, a user operated flashlight.

15 Claims, 7 Drawing Sheets

U.S. PATENT DOCUMENTS

| | | | | | |
|---|---|---|---|---|---|
| 5,609,048 | A | * | 3/1997 | Ling | 70/28 |
| 5,765,409 | A | * | 6/1998 | Yang | 70/28 |
| 5,832,752 | A | * | 11/1998 | Zeller | 70/30 |
| D401,837 | S | | 12/1998 | Chuang | |
| 5,901,587 | A | * | 5/1999 | Chen | 70/28 |
| 5,918,489 | A | | 7/1999 | Yang | |
| D427,503 | S | | 7/2000 | Brockman et al. | |
| 6,082,155 | A | | 7/2000 | Su | |
| 6,227,015 | B1 | * | 5/2001 | Luquire | 70/18 |
| 6,234,668 | B1 | | 5/2001 | Cooper | |
| D451,783 | S | | 12/2001 | Yu | |
| 6,363,758 | B1 | | 4/2002 | Ling | |
| D467,819 | S | | 12/2002 | Tang | |
| D471,430 | S | | 3/2003 | Fonfeder | |
| 6,527,434 | B1 | | 3/2003 | Fox et al. | |
| 6,935,871 | B2 | * | 8/2005 | Maurer, Jr. | 70/53 |
| D517,396 | S | | 3/2006 | Tarter et al. | |
| D548,042 | S | * | 8/2007 | Smyczek et al. | D8/334 |
| 2003/0150245 | A1 | * | 8/2003 | Lai | 70/25 |
| 2004/0103702 | A1 | * | 6/2004 | Abeler | 70/408 |

* cited by examiner

LOCK

CROSS-REFERENCE TO RELATED APPLICATIONS

This non-provisional application claims the benefit of U.S. Provisional Patent Application No. 60/521,808, entitled "Lock," filed Jul. 6, 2004, which is hereby incorporated in its entirety.

FIELD OF THE INVENTION

The present invention is directed to a lock and more particularly to a lock that incorporates a time keeping mechanism.

BACKGROUND OF THE INVENTION

Padlocks, combination locks, and other types of conventional locks are known in the art for use in a variety of applications. Locks may be used by an owner to secure many different objects against theft or accidental misplacement. Locks may include additional features, such as for example, a time keeping and display device.

Time display devices that are not worn by the user on his or her wrist or as pocket watch have become popular in the art. These devices are useful for attachment to a selected base object, such as for example, a ski jacket, a bicycle, a backpack or a life jacket. Therefore, a need exists in the art for a lock including a time display device that can secured and locked to a selected object.

The present lock offers novel features over other locks known in art and available on the market today. The shackle of the lock advantageously locks when in the closed position when attached to a selected base object. In addition, the lock secures the time display component in a manner that allows the user to rotate the display component for viewing from a variety of directions.

SUMMARY OF THE INVENTION

In several illustrated embodiments of the present invention, a lock including a time display device is disclosed. The lock may be locked to a selected base object by a user. The lock may include a locking mechanism of any known style, such as for example, a padlock or a dial combination lock.

In an embodiment of the present invention, the lock includes a housing, a series of cams, a corresponding series of dials, a locking slide assembly, a shackle and a time display component. The shackle is held closed in a locked position by the locking slide assembly. When the dials are turned to the combination setting, the shackle may be rotated open by a lever. In this position, the lock may be removed from the selected base object. The lock may include other components, such as for example, a flashlight.

Further features and advantages of the invention will become apparent from the following detailed description made with reference to the accompanying drawings.

The Detailed Description of the Invention merely describes preferred embodiments of the invention and is not intended to limit the scope of the claims in any way. Indeed, the invention as described by the claims is broader than and unlimited by the preferred embodiments, and the terms in the claims have their full ordinary meaning.

DETAILED DESCRIPTION OF THE INVENTION

A lock including a time displaying device is disclosed. The lock generally can be attached and locked to a selected object by a user. The object may be generally a larger object used as a base for convenience, or a user may desire to lock the actual object, such as for example, a school locker.

Figure 1:
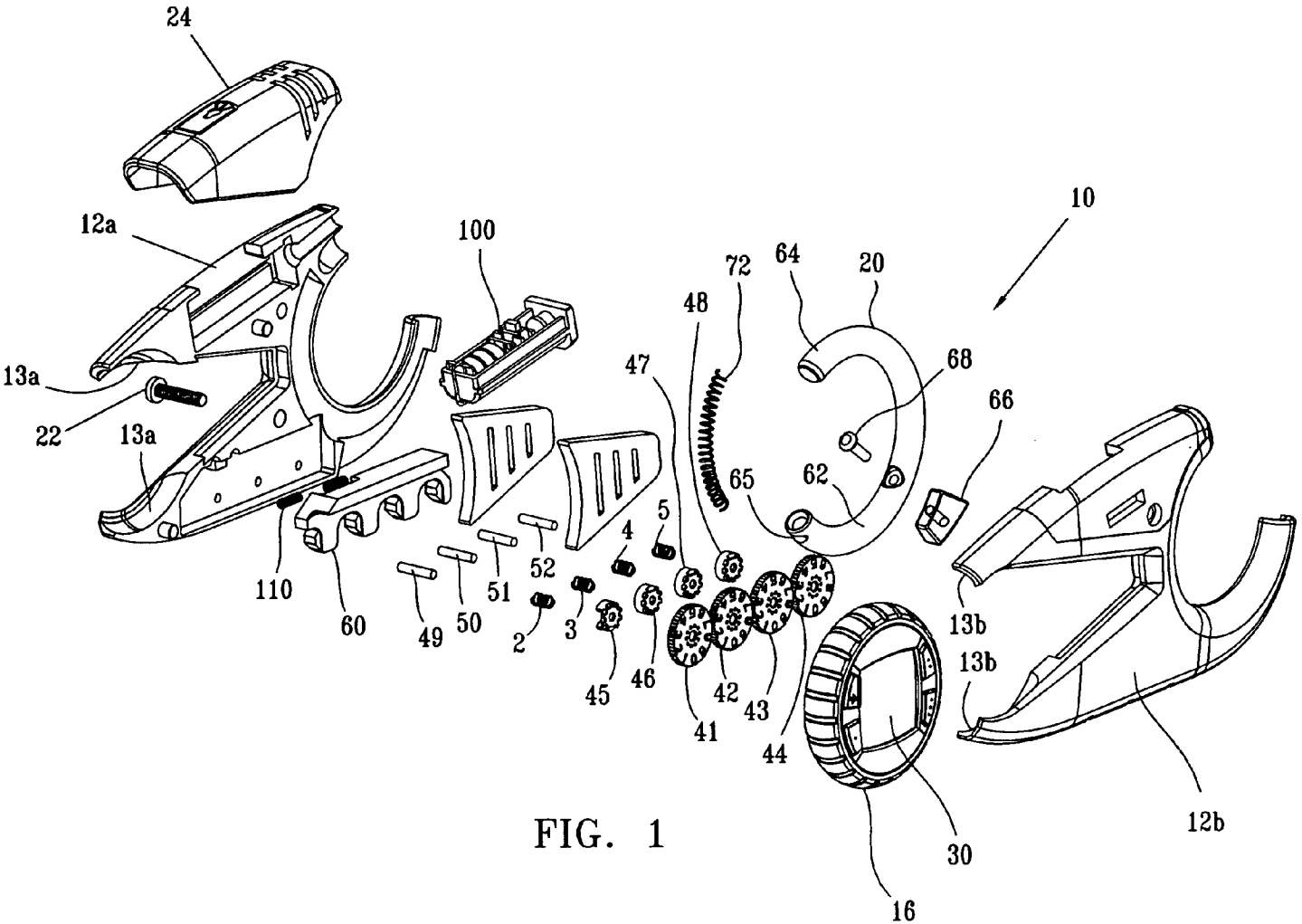
FIG. 1 is an exploded view of a lock constructed in accordance with an embodiment of the present invention, showing a lock that incorporates a time keeping mechanism.

Referring now to the drawings, FIG. 1 is an exploded view of a lock 10 constructed in accordance with an embodiment of the present invention. For reference, FIGS. 2-5 illustrate assembled views of the lock 10. The lock 10 generally includes a housing 12*a*, 12*b*, a time keeping device 16, a locking mechanism and a shackle 20.

In the embodiment illustrated in FIG. 1, the housing as shown includes a first shell 12*a* and a second shell 12*b*. The shells snap together and are held by a screw 22. Each shell includes a disk shaped portion 13*a*, 13*b* that combine to form an open clamshell for encapsulating the time keeping device 16. A top shell 24 fits over a top portion of the shells 12*a*, 12*b*.

Figure 2:
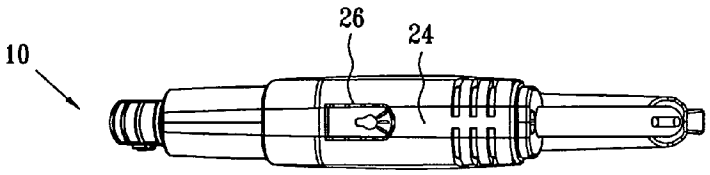
FIG. 2 is a top assembly view of the lock of FIG. 1, showing a flashlight.

The top shell 24 is illustrated in FIG. 2 which shows a top assembly view of the lock of FIG. 1. A cutout area 26 in the top shell defines a button for activating a light within the housing.

The time keeping device 16 is included to provide time related information to the user. As shown, the device 16 includes a display panel 30. It should be understood by others with ordinary skill in the art that in the practice of the present invention, many forms of time related information can be displayed on this panel.

Figure 3:
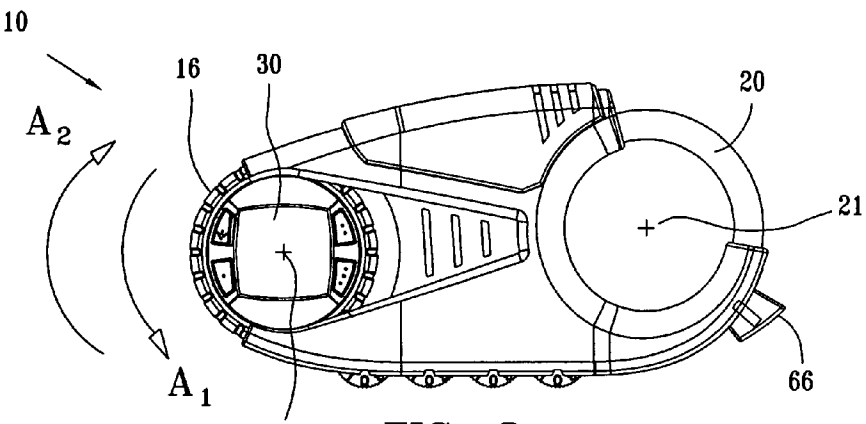
FIG. 3 is a front assembly view of the lock of FIG. 1, showing a shackle in a closed position.
Figure 4:
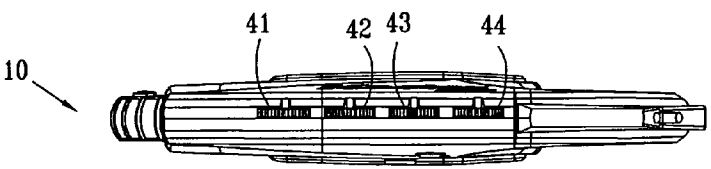
FIG. 4 is a bottom assembly view of the lock of FIG. 1, showing a set of dials.
Figure 5:
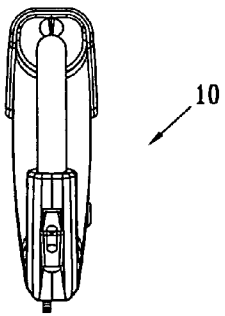
FIG. 5 is a side assembly view of the lock of FIG. 1, showing a shackle in a closed position as in FIG. 3.
Figure 6:
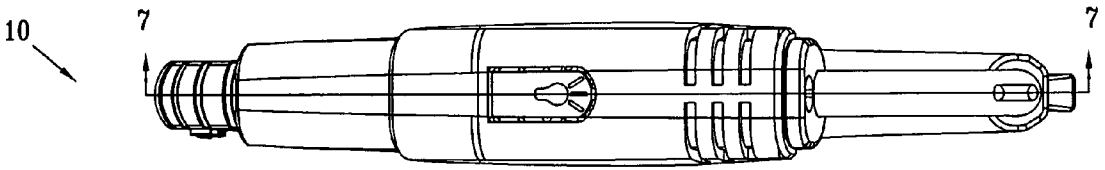
FIG. 6 is an enlarged top assembly view of the lock of FIG. 1.

FIG. 3 is a front assembly view of the lock of FIG. 1. The time keeping device 16 is retained within the housing as previously discussed. While retained, the device 16 can be rotated by a user in a direction $A_1$ or $A_2$ about a center point 17 of the device. This feature permits a user to view the display panel 30 from a variety of directions.

The locking mechanism is provided for locking the time keeping device 46 to a selected object by a user. The locking mechanism generally operates in concert with a slidable shackle and a means for locking the shackle in position. In the embodiment illustrated in FIGS. 1-11, the locking means includes four combination dials that operate in conventional locking fashion. It should be appreciated by others with ordinary skill in the art that other locking means can be used in the practice of the present invention, such as for example, key operated or other combination mechanisms.

Figure 11:
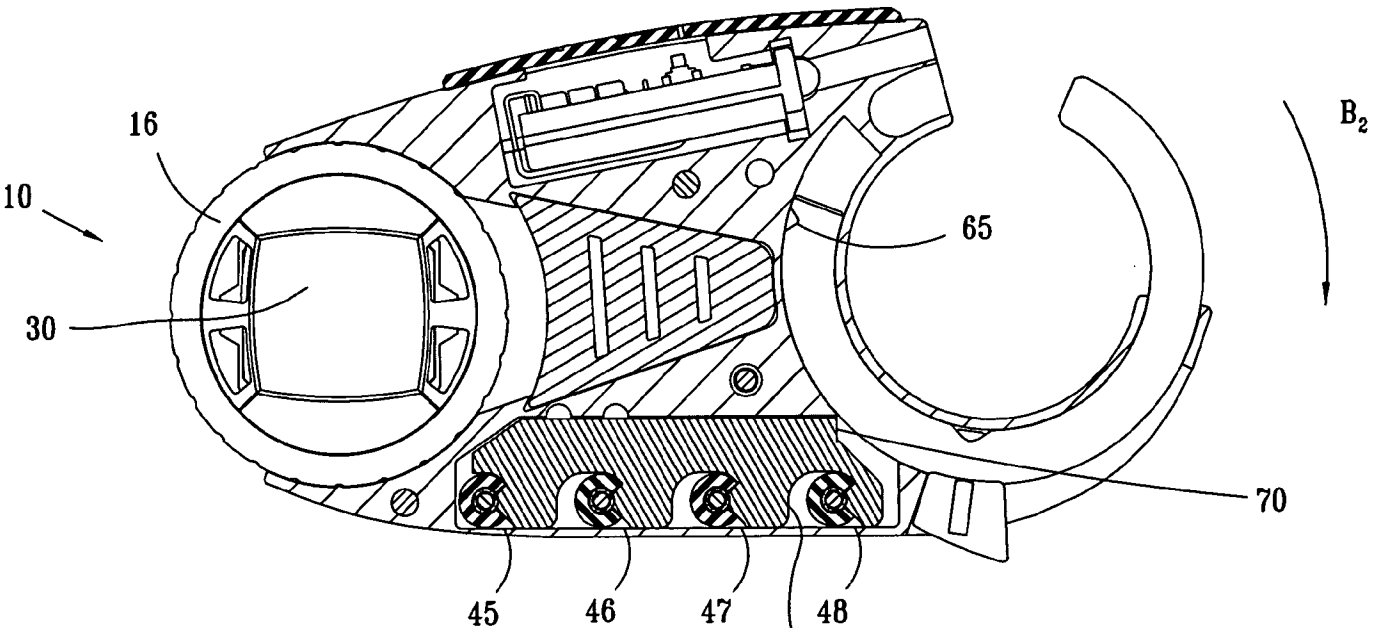
FIG. 11 is a front view, partially in section, of the lock of FIG. 1 as seen along the line 11-11 in FIG. 10, showing the shackle in an unlocked position and a set of cams turned to an unlocked combination position.

Referring again to FIG. 1, the locking mechanism includes a series of combination dials 41, 42, 43, 44 and a series of cams 45, 46, 47, 48. The dials and cams form four sets, each set including a dial and cam (41, 45), (42, 46), (43, 47), (44, 48) coaxially mounted about a pin 49, 50, 51, 52. A set of springs 2, 3, 4, 5 bias the cams toward the dials. The dials are rotatable by a user such that a rotational position of a cam is determined by a rotational position of its corresponding dial. As shown in FIG. 11, when the series of cams 45, 46, 47, 48 are manipulated to a certain position by the user, notches in the cams align with protrusions in a locking slide 60.

Figure 7:
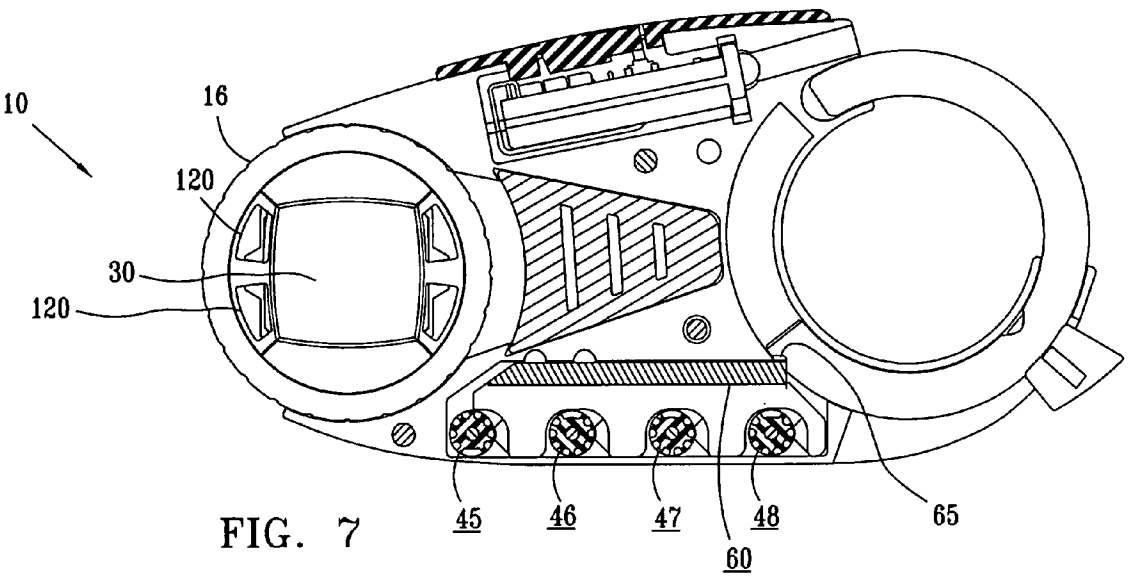
FIG. 7 is a front view, partially in section, of the lock of FIG. 1 as seen along the line 7-7 in FIG. 6, showing the shackle in a locked position.
Figure 8:
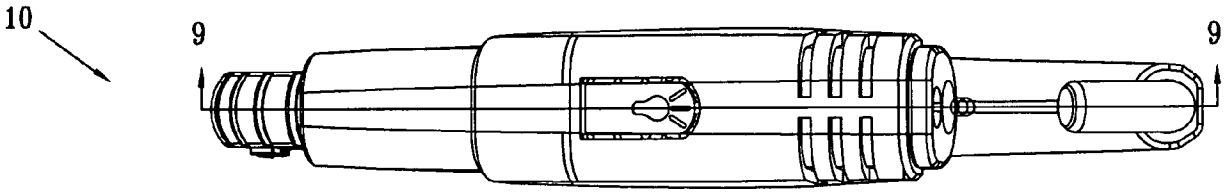
FIG. 8 is an enlarged top assembly view of the lock of FIG. 1.
Figure 9:
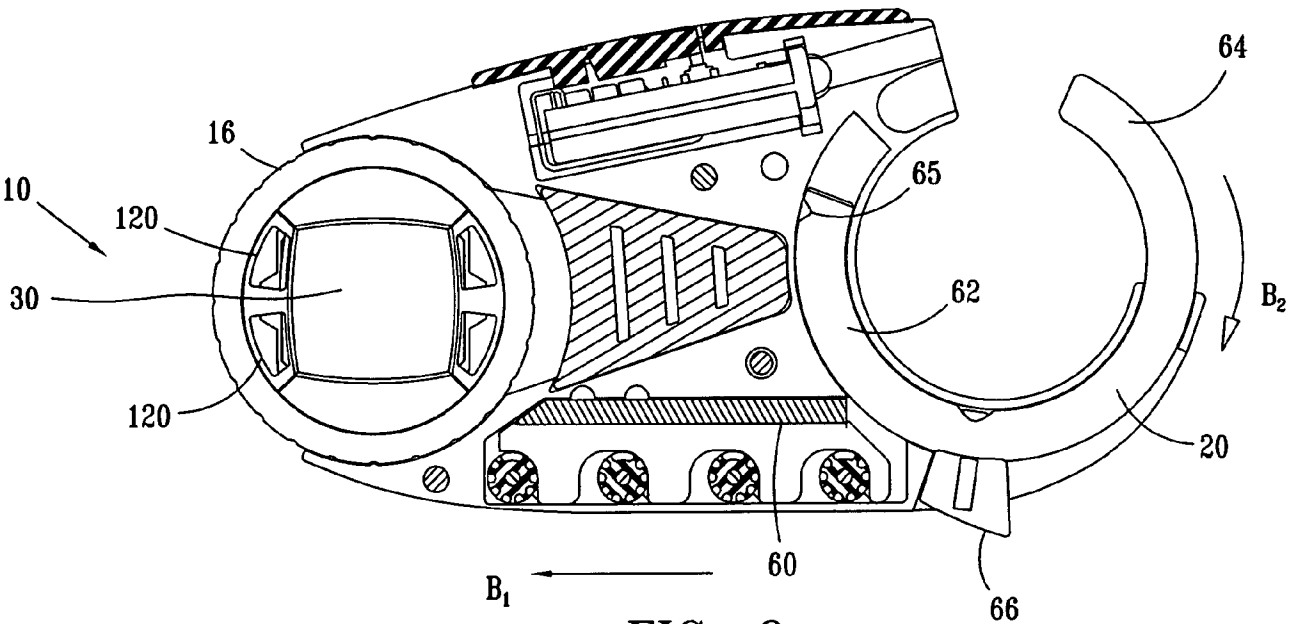
FIG. 9 is a front view, partially in section, of the lock of FIG. 1 as seen along the line 9-9 in FIG. 8, showing the shackle in an unlocked position.

As mentioned, the locking mechanism further includes a locking slide 60. The slide 60 is spring biased in a direction away from the shackle 20, but engages the shackle in a locked position as shown in FIG. 7. As shown in FIGS. 9 and 11, when the dials 41, 42, 43, 44 are turned to match a unique combination, notches in the cams align with protrusions in a locking slide 60 and the locking slide moves in a direction away from the shackle and disengages from the shackle 20. More specifically, the locking slide 60 moves in the direction $B_1$ away from the shackle 20 as shown in FIGS. 8-9. FIG. 8 is an enlarged top assembly view of the lock 10 and FIG. 9 is a front view, partially in section, of the lock 10 seen along the line 9-9 in FIG. 8. The shackle 20 is shown in an unlocked position in FIGS. 8-9.

Figure 10:
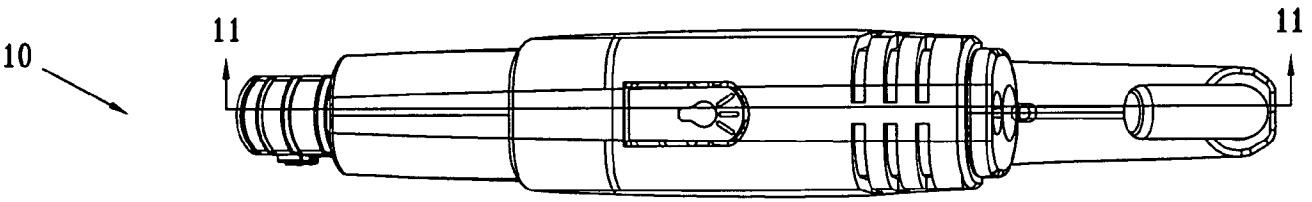
FIG. 10 is an enlarged top assembly view of the lock of FIG. 1.

FIG. 10 is an enlarged top assembly view of the lock 10 and FIG. 11 is a front view, partially in section, of the lock 10 as seen along the line 11-11 in FIG. 10. The shackle is shown in an unlocked position and a set of dials cams 45, 46, 47, 48 turned to an unlocked combination position. In this position, the locking slide 60 moves in the direction $B_1$ away from the shackle 20 to allow the lock 10 to open. Subsequently, a user may rotate the shackle in a direction $B_2$ to open the lock 10.

The shackle 20 is lockable and allows a user to prevent theft or accidental misplacement of the lock 10. The shackle includes a first portion 62 disposed within the housing 12*a*, 12*b* and a second portion 64 disposed between an open position and a closed position. FIG. 3 is a front assembly view of the lock of FIG. 1, showing a shackle in a closed position. FIG. 9 is a front assembly view of the lock of FIG. 1, showing a shackle 20 in an open position.

The shackle 20 includes several features relevant to locking the shackle and to moving the shackle after disengagement from the locking slide 60. The shackle includes a notch 65 on an outer surface, as best seen in FIG. 9. The notch 65 is shown engaged with a flat engagement surface 70 of the locking slide 60 in FIG. 7. The flat surface 70 is best seen in FIG. 11. When the flat surface 70 is engaged with the notch 65, the shackle is locked.

The shackle 20 also includes a lever 66 and a screw 68 attached to the shackle 20 as shown in FIG. 1. When the locking slide 60 is disengaged from the shackle notch, a user may manipulate the shackle 20 from the position shown in FIG. 7 to the position shown in FIGS. 9 and 11 by using lever 66. After a user releases the lever 66, a shackle spring 72 biases the shackle 20 back to the closed position shown in FIG. 3. At this point, a user may reset the combination dials to again lock the device 10 to a selected object, or merely place the shackle in a locked position.

Figure 13A:
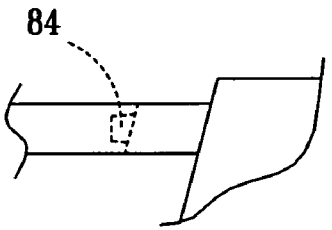
FIG. 13*a* is a front view of a portion of the lock of FIG. 12, showing the shackle in a closed position.
Figure 13B:
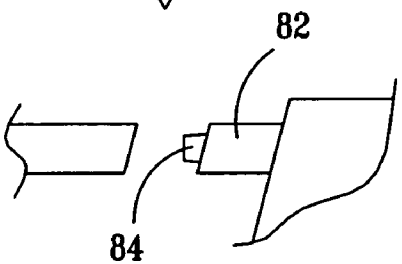
FIG. 13*b* is a front view of a portion of the lock of FIG. 12, showing the shackle in an open position.
Figure 12:
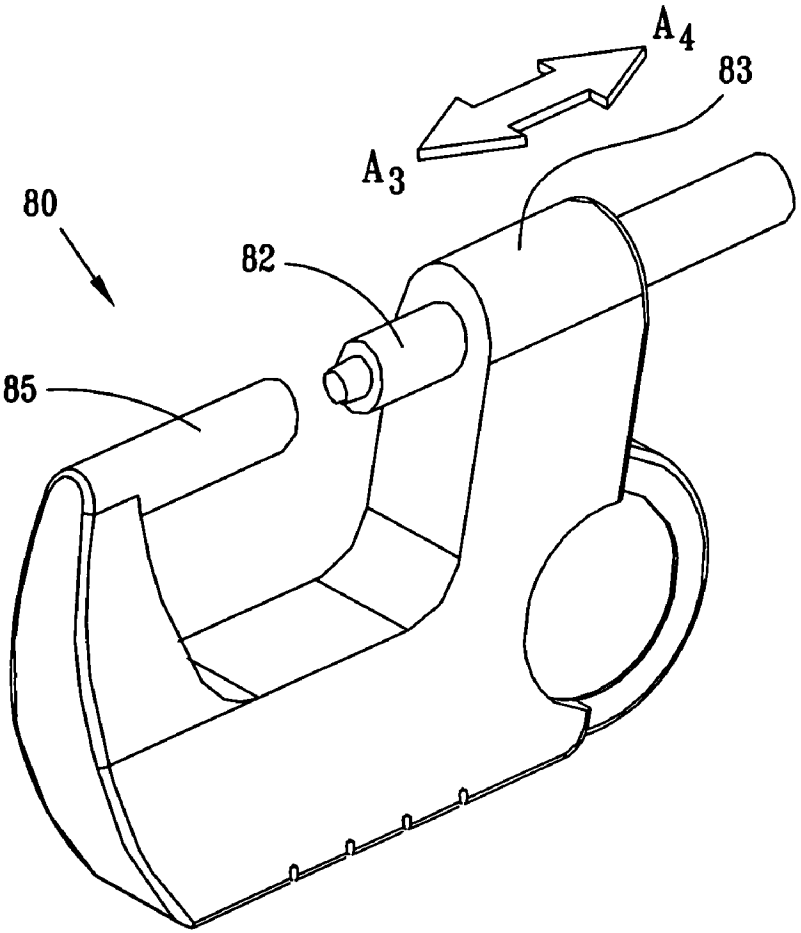
FIG. 12 is a perspective view of a lock constructed in accordance with another embodiment of the present invention, showing a lock with an alternative shackle structure and location.

In the embodiment shown in FIGS. 1-11, the shackle 20 is ring-shaped and rotatable about its center point. Other shackle designs may be utilized in the practice of the present invention. For example, FIG. 12 is a perspective view of a lock constructed in accordance with another embodiment of the present invention. A lock 80 is shown with a shackle 82 having alternative structure and location. The shackle is an elongated straight member. The shackle 82 is slidable in a direction $A_3$ or $A_4$ through a base portion 83 of the lock 80. A distal portion 84 of the shackle 82 has a narrowed diameter to reduce interference and twisting upon entry into a receptacle member 85. FIG. 13*a* is a front view of a portion of the lock 80 of FIG. 12, showing the shackle 82 in a closed position and FIG. 13*b* shows the shackle in an open position. A locking member can be used to lock the shackle 82 in place.

Figure 15A:
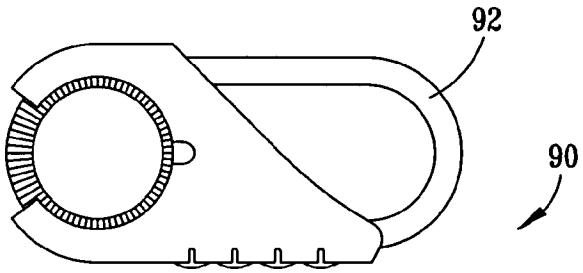
FIG. 15*a* is a front view of a portion of the lock of FIG. 14, showing the shackle in a closed position.
Figure 15B:
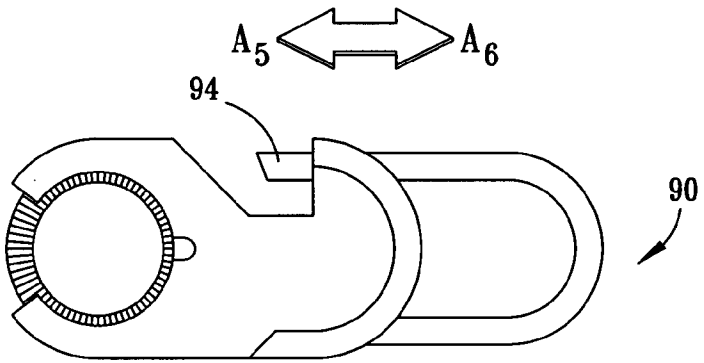
FIG. 15*b* is a front view of a portion of the lock of FIG. 14, showing the shackle in an open position.
Figure 14:
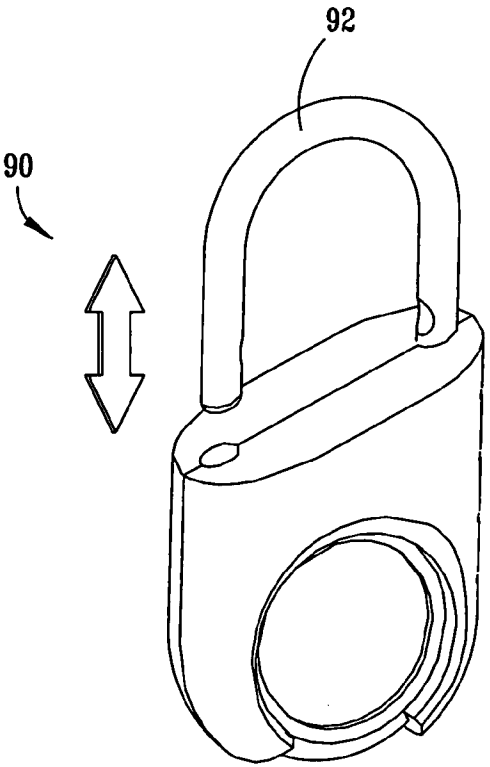
FIG. 14 is a perspective view of a lock constructed in accordance with yet another embodiment of the present invention, showing a lock with an alternative shackle structure and location.

FIG. 14 is a perspective view of a lock constructed in accordance with yet another embodiment of the present invention. A lock 90 is shown with a shackle 92 having alternative structure and location. The shackle is slidable in a direction $A_5$ or $A_6$ into a body portion of the lock 90. FIG. 15*a* is a front view of a portion of the lock 90 of FIG. 14, showing the shackle 92 in a closed position and FIG. 15*b* shows the shackle 92 in an open position. A locking member can be used to lock the shackle 92 in place.

Referring again to FIGS. 1-11, the shackle 20 locks in the closed position thereby preventing access to that which is locked and also prevents accidental removal of the lock 10. In other words, the shackle 20 could be used for example to lock a school locker.

The lock mechanism incorporates a resettable combination lock engaging the circular shackle 20. In the locked state, at least one cam 45, 46, 47, 48 interferes with a locking slide assembly keeping it engaged with the shackle. When the correct combination is set with the combination dials 41, 42, 43, 44 features of the locking slide assembly align with the cams allowing the locking slide 60 to move out of engagement from the shackle 20. The shackle 20 can then be opened with a rotational movement about the center point 21 of the shackle. As best shown in FIG. 7, a shackle can easily be removed by a lever 66 that is connected to the shackle. By applying force to the lever 66 and moving it along the edge of the lock housing, the shackle can be rotated to the unlocked position, wherein an opening is formed between the lock housing and the shackle housing extension. The unlocked position is illustrated in FIG. 9. A spring 72 can be placed in the shackle opening to bias the shackle into the closed position. When the spring 72 is used, the shackle 20 will return to the closed position by removing the force applied to the lever.

When the combination has been set, the combination dials 41, 42, 43, 44 interact with the locking slide 60 to keep it from moving. The locking slide includes a portion that engages a notch 65 in the shackle to prevent movement of the shackle. When the correct combination is dialed, the combination dials are orientated to allow the locking slide 60 to move. Rotation of the lock shackle moves the locking slide out of the notch in the shackle, as camming forces move the locking slide 60 away from the shackle 20. The shackle is then free to rotate until it returns to the closed position, wherein the locking slide 60 reengages the notch 65 in the shackle 20. One or more springs 110 can be incorporated to bias the locking slide 60 towards the shackle 20.

The lock further includes a time piece 16, generally positioned at the opposite end of the lock body as the shackle. In the embodiment shown in FIGS. 1-11, the time piece includes a face, one or more function-related buttons 120, and a gripping surface located about the periphery of the time piece body. The time piece is encapsulated between two halves 12*a*, 12*b* of the lock housing with an edge partially exposed to allow rotation of the time piece into any position about the plane of the face, but not exposed enough to allow for removal of the time piece. The time piece 16 may include functions such as time display, day and date display, stopwatch functions and an alarm. Other features can also be incorporated. The display can be either a mechanical display or a digital display. In some embodiments, more advanced circuitry can be included to provided for additional features. In some embodiments, the lock body incorporates a flashlight 100 which is generally comprised of an LED light operated via a button on the lock body, as shown in FIG. 1.

In another embodiment of the present invention, a lock for securing to a selected base object is disclosed. The lock includes means for locking the lock to the base object. The lock may be a padlock, a dial combination lock, or any other known structure having a lockable shackle. The lock further includes means for displaying time related information. The lock may further include means for illumination of a portion of the base object. The illumination may be a light source operated by various methods, such as for example, a push button, a timer, or a slide button.

While several embodiments of the invention has been illustrated and described in considerable detail, the present invention is not to be considered limited to the precise constructions disclosed. Various adaptations, modifications and uses of the invention may occur to those skilled in the arts to which the invention relates. It is the intention to cover all such adaptations, modifications and uses falling within the scope or spirit of the claims filed herewith.

What is claimed is:

1. A lock for securing to a selected base object by a user, said lock comprising:

a) a housing;

b) a time keeping device secured to said housing, the time keeping device being only partially radially surrounded by the housing, such that an outermost peripheral edge of the time keeping device may be gripped by a user to rotate the time keeping device with respect to the housing;

c) a locking mechanism attached to said housing; and d) a shackle having a first portion disposed within said housing and a second portion positionable between an open position and a closed position;

e) wherein said shackle is movable between said open position and said closed position by user manipulation of said locking mechanism.

2. The lock of claim 1 wherein said shackle is ring-shaped and rotatable about a center point thereof.

3. The lock of claim 1 wherein said shackle is u-shaped.

4. The lock of claim 1 wherein said shackle is an elongated straight member.

5. The lock of claim 1 wherein said locking mechanism comprises a locking slide assembly, wherein said locking slide assembly engages said shackle in said closed position and prohibits shackle movement.

6. The lock of claim 1 further comprising a flashlight attached to said housing.

7. A lock comprising:

a housing;

a time display device attached to said housing, wherein said time display device includes a panel rotatable about a center point thereof;

a locking mechanism at least partially contained within said housing and comprising a plurality of dials and a locking slide; and a rigid, non-pivoting shackle secured by said housing, said shackle being ring-shaped and rotatable about a center point thereof;

wherein said shackle is slidable between a locked condition and a unlocked condition by user manipulation of said plurality of dials;

further wherein said locking slide engages said shackle in said locked condition and disengages from said shackle in said unlocked position.

8. The lock of claim 7 wherein said locking mechanism further comprises a series of dial and cam sets, wherein each of said sets includes one of the plurality of dials and at least one co-axially mounted cam, such that a rotational position of said at least one cam is determined by a rotational position of said corresponding dial; wherein said locking slide engages said shackle in a locked position and disengages from said shackle in an unlocked position only when said plurality of dials is turned to a correct combination.

9. The lock of claim 8 wherein said locking slide is spring biased away from said shackle.

10. The lock of claim 8 wherein said locking slide moves away from said shackle when said plurality of dials is turned to a correct combination.

11. The lock of claim 8 wherein said shackle comprises a lever for user manipulation of said shackle when said locking slide assembly is disengaged from said shackle.

12. The lock of claim 7 further comprising a flashlight attached to said housing.

13. The lock of claim 7, wherein the locking slide is configured to engage a notch in an outer periphery of the shackle.

14. A lock for securing by a user to a base object, said lock comprising:

a housing;

a time keeping device having a display face and rotatably secured to said housing;

a locking mechanism attached to said housing and comprising:

a series of dial and cam sets, wherein each of said sets includes one dial and at least one co-axially mounted cam, such that a rotational position of said at least one cam is determined by a rotational position of said corresponding dial;

a locking slide engagable with each of said cams;

a ring-shaped shackle in communication with said locking slide; and an actuator lever extending radially outward from an outer peripheral surface of said shackle;

wherein said shackle is movable between a closed position and an open position by user manipulation of said lever when said plurality of user rotatable dials is turned to a proper combination.

15. The lock of claim 14 wherein said housing defines a surface cavity and said lock further comprises a flashlight attached to said housing within said cavity.

* * * * *